United States Patent [19]

Arvedi et al.

[11] Patent Number: 4,562,682

[45] Date of Patent: Jan. 7, 1986

[54] THREE-DIMENSIONAL RETICULATED STRUCTURE WITH RODS HAVING TAPERED ENDS

[75] Inventors: Giovanni Arvedi, Cremona; Giovanni Gosio, Rovato; Renzo Piano, Genoa, all of Italy

[73] Assignee: Ingegneria Siderurgica S.r.l., Cremona, Italy

[21] Appl. No.: 532,530

[22] Filed: Sep. 15, 1983

[30] Foreign Application Priority Data

Sep. 16, 1982 [IT] Italy ..... 23301 A/82

[51] Int. Cl.[4] ..... E04C 3/02; E04H 12/06

[52] U.S. Cl. ..... 52/648; 52/DIG. 10; 403/171; 403/176

[58] Field of Search ..... 52/648, DIG. 10, 650, 52/655, 81; 403/170, 171, 172, 174, 176

[56] References Cited

U.S. PATENT DOCUMENTS

| | | | |
|---|---|---|---|
| 3,309,121 | 3/1967 | Fentiman | 403/176 |
| 3,995,962 | 12/1976 | Mylaeus | 52/648 X |
| 4,027,449 | 6/1977 | Alcalde Cilveti | 52/648 |
| 4,183,190 | 1/1980 | Bance | 52/648 |
| 4,313,687 | 2/1982 | Martinez Apeztegui et al. | 403/171 |
| 4,355,918 | 10/1982 | Van Vliet | 403/170 |
| 4,357,118 | 11/1982 | Murray | 403/176 X |

FOREIGN PATENT DOCUMENTS

| | | | |
|---|---|---|---|
| 2526660 | 12/1976 | Fed. Rep. of Germany | 52/648 |
| 1391973 | 2/1965 | France | 52/648 |
| 2390613 | 1/1979 | France | 403/171 |
| 620563 | 8/1978 | U.S.S.R. | 52/648 |

*Primary Examiner*—Donald G. Kelly
*Assistant Examiner*—Richard E. Chilcot, Jr.

[57] ABSTRACT

A three-dimensional reticulated structure or space lattice structure is formed of metal rods tapered at their ends so that the loss of cross-section leads to a thickening of the tubular wall of the rod, whereby it can be threaded at its ends by removal of material without losing mechanical strength. This is preferably attained by coining through at least six successive passes in dies of increasingly smaller dimensions. The knots or junctions are bored metal cups, said rods converging into the bores thereof and being fixed simply by bolts. A plug of concrete reinforced with steel fibres closes the base of the cup while allowing its reopening for inspection and maintenance, and provides further mechanical strength to the assembly.

7 Claims, 5 Drawing Figures

THREE-DIMENSIONAL RETICULATED STRUCTURE WITH RODS HAVING TAPERED ENDS

BACKGROUND OF THE INVENTION

This invention relates to space lattice structures, such as those used currently for flat and curved platforms, for large-span beams, scaffolding, coverings for industrial plants and sports complexes, etc.

It is known that such lattice structures have been heretofore constructed in various ways, nearly always using tubular rods of constant cross-section, which converge in various numbers into knots which are usually of cubic or substantially spherical shape, and in any case closed. However, such systems have certain drawbacks, among which is that the knots or junctions are formed as closed geometrical solids provided with threaded bores into which the ends of the tubular rods are screwed, whereby the assembly has a certain rigidity with little facility for adjusting the lengths, and difficulty in dismantling. However, the most serious drawback is due to the fact that as the tubular rods are of constant cross-section, and as they have to be threaded at their ends for connection to the knot, there is a clear reduction in the resistant cross-section by virtue of the removal of material due to the threading, with consequent reduction in the mechanical strength at the point of connection with the knot, which is a zone of weakness for the whole structure, unless the rod thickness is overdimensioned, with considerable additional costs.

It has been sought to solve this problem by using tubular rods with tapered ends, these ends being substantially frusto-conical elements welded to said rods and each incorporating a bolt for screwing into the threaded bores provided in the knots. However, although this solution overcomes the aforesaid drawbacks fairly well, it is of rather costly and critical construction because of the welding and of the incorporated bolt, and also does not allow inspection of the junctions, which are again of closed type, unless the structure is dismantled.

SUMMARY OF THE INVENTION

It is the object of the present invention to provide a tri-dimensional or space lattice structure comprising metal rods in a single piece which are tapered at their ends in such a manner that the reduction in cross-section gives a corresponding thickening of the walls, so that the threading carried out by removal of material does not lead to weakening at the connection zone with the knots. These latter are formed as metal cups open at one end and provided with unthreaded bores, and of low cost as they are constructed for example by cold drawing.

According to the present invention, an essential element for the assembly of the structure is provided, formed as a "plug" or disc for covering the cup-shaped knot, its main purpose being to make said knot indeformable so that it cannot be deformed. Said element is preferably of concrete reinforced with steel fibres, and is removably fixed to the cup so as to allow periodic inspection and maintenance of the junction, while maintaining the structure in its integral state.

According to a further characteristic of the present invention, the tubular rods are tapered at their ends by a coining process repeated at least six times by successive passes through increasingly more conical dies.

BRIEF DESCRIPTION OF THE DRAWING

These and further characteristics of the present invention will be apparent to those skilled in the art from the detailed description of a preferred embodiment thereof given hereinafter by way of non-limiting example with reference to the accompanying drawings, in which.

DETAILED DESCRIPTION OF THE PREFERRED EMBODIMENT

With reference to the drawings, the space lattice structure according to the invention substantially comprises rods, which function as ties or struts according to the stresses and load distribution, and junction knots each of which comprises a steel cup and a reinforced concrete disc. Bolts, nuts and washers of known type are also obviously required for the assembly.

Figure 1:
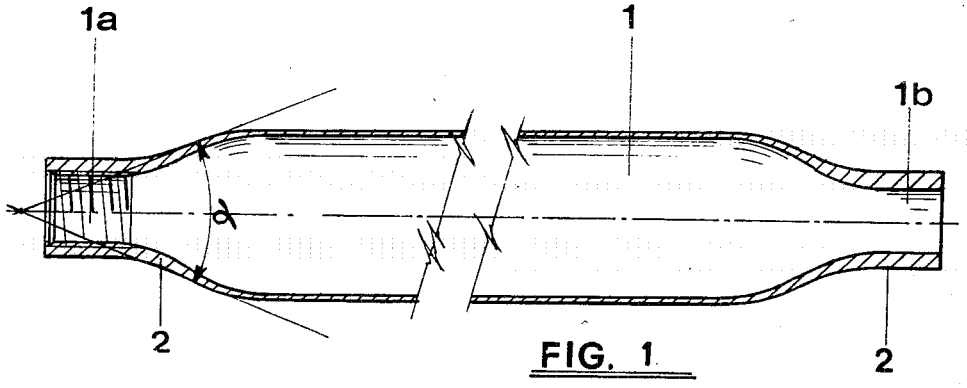
FIG. 1 is a partial, diagrammatic, longitudinally sectional view through a tubular rod for the structure according to the present invention.

FIG. 1 shows a rod according to the present invention, made from a usual constructional steel tube, not overdimensioned, which has been tapered at both ends in order to obtain a thickening of the walls in that zone, corresponding to the reduction in the outer diameter. According to the invention, by means of a special coining process in successive stages comprising at least six passes through dies having an increasingly greater cone angle, a reduction in the diameter of the tube at its ends is obtained up to a value of 50%, with a corresponding increase in the wall thickness. The interior of the terminal parts of the rod is then threaded in known manner.

In FIG. 1, the rod 1 is shown in a side view at the central zone and sectioned at its ends. Of these latter, the end 1*a* is threaded and the end 1*b* is shown before threading. It can be seen that the wall 2 at the ends is considerably thicker than in the central tubular part, and is such as to provide a thickness at the thread root which is not less than that of the remaining part of the rod 1. The cone angle $\alpha$, for example 60°, corresponds to the angular aperture of the die used in the last tube coining stage. The coining operation is also controlled so as to obtain an approximately 15% increase in the mechanical characteristics by work-hardening without this reducing the strength.

Figure 2:
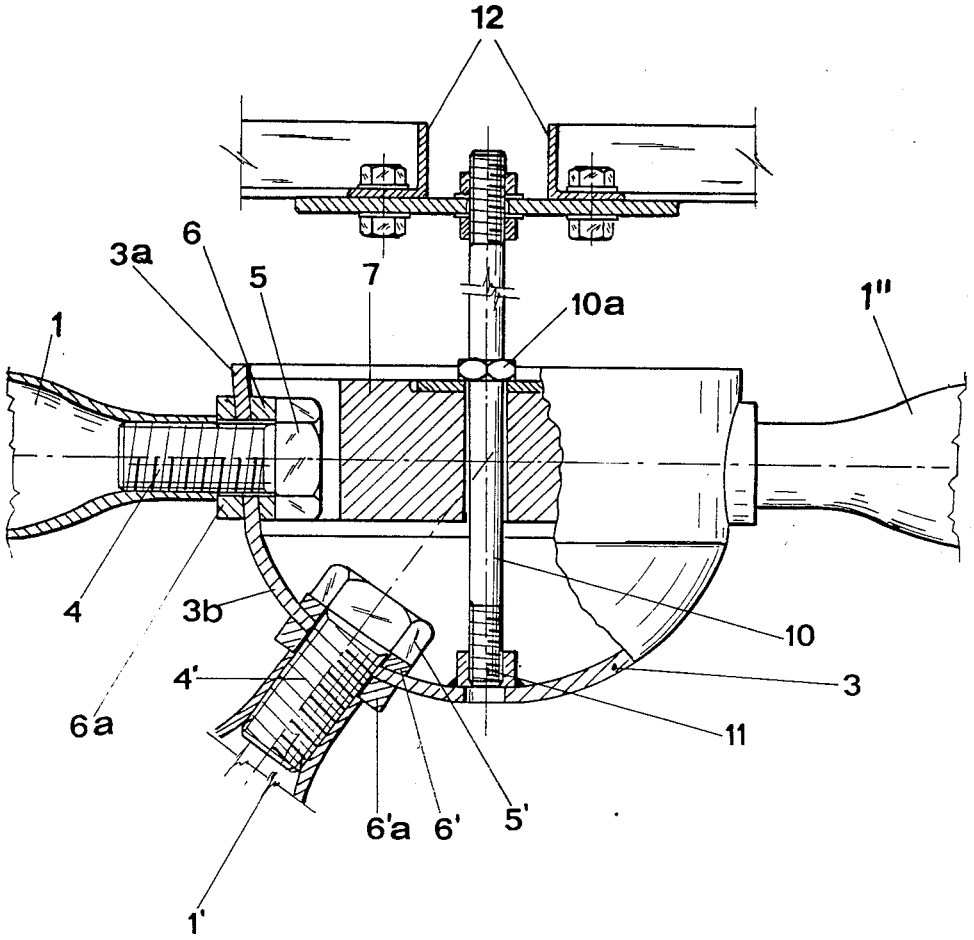
FIG. 2 is a partly sectional view of a junction knot of the structure according to the invention, into which several rods illustrated in FIG. 1 converge.

FIG. 2 shows a partly sectional view of a knot of the lattice structure according to the present invention. It can be seen that the knot or junction into which several rods 1, 1', 1'' converge (in this case three are shown, but they can be of greater or lower number), is substantially formed of a steel cup 3, obtained for example by simple cold drawing and preferably having a substantially frusto-conical part open at the major base, and a part of constant curvature 3*b* which is substantially in the form of a spherical cap and is connected to the minor base of said frusto-conical zone 3*a*. The necessary bores are provided in said cup for the passage of the ends 1*a* of the rods 1 and for the connection to the latter. The connection is made by bolts 4, 4' with threaded shank which are screwed into the inner threaded ends 1*a* of the rods 1 by operating on the hexagonal head 5 of each bolt by means of suitable tools. A washer 6 with non-parallel surfaces is inserted between the inner wall of the cup 3 and the head 5, and a corresponding washer 6*a* is provided on the outside of the cup 3 forming the junction, about the end of each rod 1 which converges into said junction or knot. Said washer 6 and 6*a* pertaining to the rods 1 connected to the cup 3 in its upper frusto-conical zone have a different configuration from those, indicated by 6' and 6'*a* respectively, used for the connections in the spherical zone of the cup 3. The type of asymmetric assembly shown in FIG. 2 is obviously extremely unlikely in reality, but has been illustrated in order to show the possible coupling situations. The distribution of bores in the cup 3 and thus the spatial arrangement of the rods which converge into the knot depends on the particular structure required, and on the position occupied by the knot in the structure itself, as will be more apparent hereinafter with reference to FIG. 5.

Figure 3:
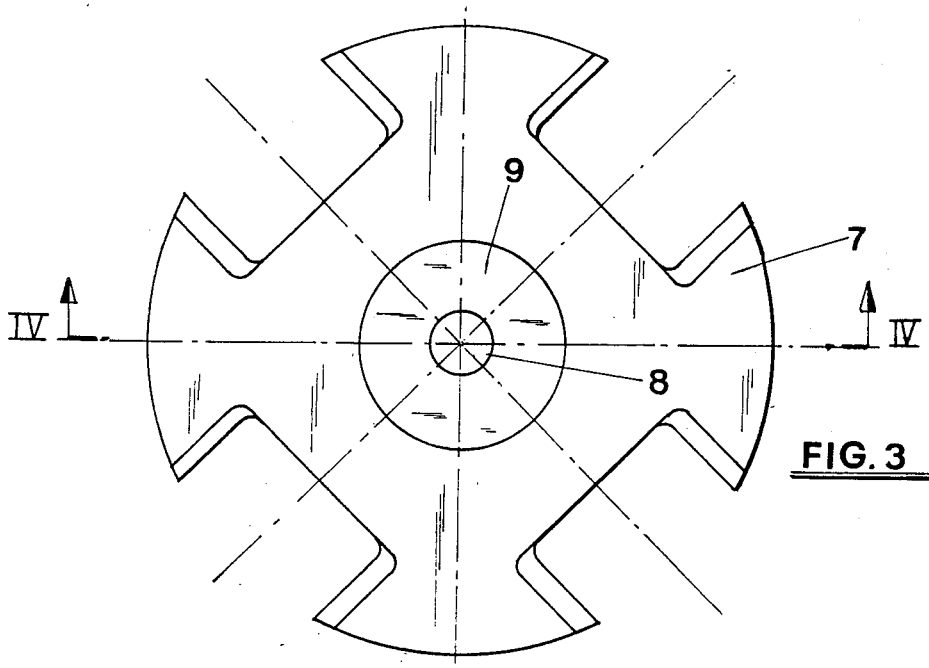
FIGS. 3 and 4 are respectively a top plan view and a cross-section along the line IV—IV of FIG. 3, of a covering and strengthening element or "plug" for use in the junction of FIG. 2 of the structure according to the invention.
Figure 4:
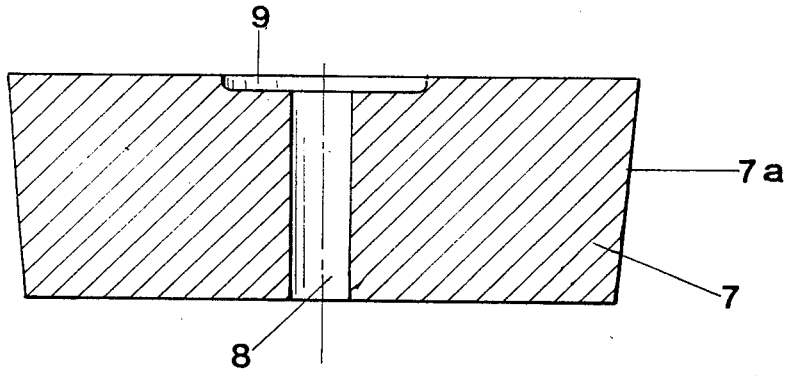

Returning to FIG. 2, the reference numeral 7 indicates a covering and strengthening element or "plug", shown in greater detail in FIGS. 3 and 4. This element is preferably of concrete reinforced with steel fibres of small size, for example having a length of up to 2 cm. It ensures that the junction cannot be deformed and at least a partial protection of the connections, and can also be removed for any inspection for checking the connections and for the periodic maintenance of the structure. It comprises substantially a disc 7 of diameter equal to the inner diameter of the cup 3 in its open zone, and having frusto-conical side surfaces so as to mate with the band-shaped zone 3*a* of the cup. There is also provided a central through hole 8 and a possible washer seat 9 for fixing the plug 7 to the cup 3 by means of a central tie rod 10 to which said plug is bolted as shown in FIG. 2. A pin or boss 11 fixed at the central point of the cup 3 keeps the tie rod 10 in position, and the positioning of the plug 7 is ensured by the nut 10*a* and the frusto-conical shape of the two surfaces. Along the periphery of the plug 7 there are provided notches corresponding to the number of connections with the rods 1 provided along the band zone 3*a*. FIG. 3 shows the fairly common case in which four coplanar rods converge into one knot or junction.

The tie rod 10 can either terminate immediately outside the nut 10*a* or project for a certain distance beyond the plug 7 so as to form a connection point for panels, false ceilings, light points, various systems such as air conditioning etc. This facility is illustrated diagrammatically in FIG. 2, in which a connection with panels 12 is provided. Where these are in the form of a false ceiling, the space lattice structure can provide a roof covering for a large area.

Figure 5:
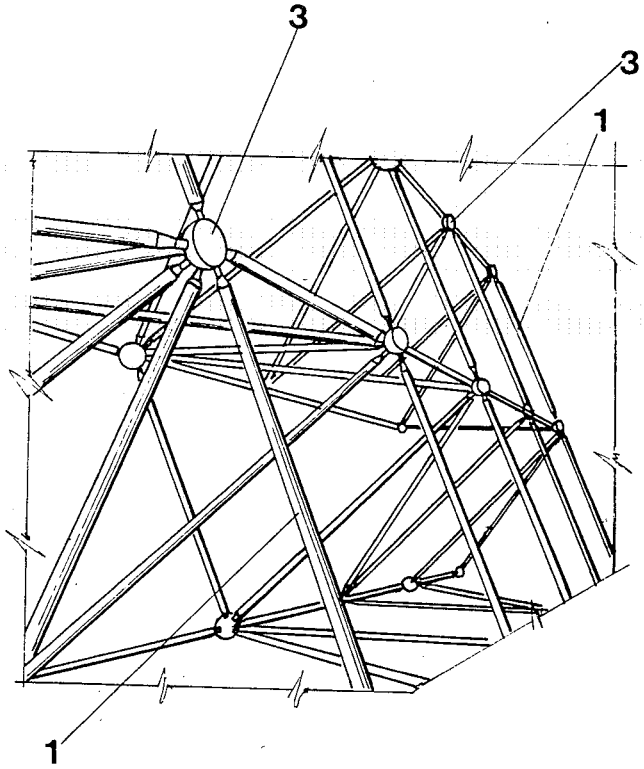
FIG. 5 shows an example of a space lattice structure according to the invention.

FIG. 5 shows an assembly example of the structure according to the present invention, intended for scaffolding for display purposes. As can be seen, eight rods converge into the central knots of the structure, four of which are coplanar along the outer band 3*a* of the cup, and four extend obliquely from the cap 3*b*. The outer knots have five rods, three of which are coplanar and converge on to the outer band, and the knots at the vertices of the structure have a total of four rods.

The advantages of the structure heretofore described and illustrated are apparent from the aforegoing, in particular with regard to its wide range of possible geometrical compositions, as the cup knot surface can be bored in different positions and allows a large number of rods to converge, but more especially with regard to the structure of the rod itself, which is tapered at its ends by the aforesaid coining process to a coining degree of 50% of the diameter, which has never been previously attained, with simultaneous thickening of the tube wall in the zone to be threaded. In a practical test, it was found that a steel rod of the type described for constructional work, type Fe52 with a tube thickness of 6 mm, resisted both a compression and tensile force of 50 t.

Additions and/or modifications can be provided by those skilled in the art for the described and illustrated embodiment of the lattice structure according to the present invention without departing from the scope of the invention itself as defined in the appended claims.

What we claim is:

1. A space lattice structure comprising tubular metal rods, each rod being an integral single piece, junction knots in which at least one of said metal rods converge, said single-piece rods being tapered and their walls at both their ends being thickened and internally threaded, each of said knots comprising a metal cup open at one end and provided with non-threaded bores, a knot covering and strengthening element removably fixed in each cup in the zone of its greatest diameter so that said knot cannot be deformed, each end of each rod being fixed to a corresponding cup by means of a bolt screwed therein which is accessible from the inner side of the cup, and washers of non-parallel surfaces respectively in contact with inner and outer surfaces of the cup.

2. A lattice structure as claimed in claim 1, wherein the diameter at the ends of each rod is reduced to about 50% of the initial diameter of the tubular rod, the thickness of the tubular wall at each end of the rod at the thread root being at least the same as along the remaining portions of the tubular rod.

3. A lattice structure as claimed in claim 1, wherein each cup comprises in its open zone of greatest diameter a frusto-conical band, of which the major base coincides with the outer edge of said cup, and a spherical cap zone connected to the minor base of said zone, at least one of said zones having at least one bore.

4. A lattice structure as claimed in claim 3, wherein said strengthening element is mounted in said cup in a position corresponding with said frusto-conical band, and in order to mate therewith, it has a lateral surface also of frusto-conical configuration, said element also comprising a recess along its periphery in a position corresponding with each bore formed in said band and a central through hole.

5. A lattice structure as claimed in claim 1, wherein said strengthening element is made of concrete reinforced with steel fibres.

6. A lattice structure as claimed in claim 4, further comprising tie rod means for mounting said strengthening element into said cup, the tie rod means passing through said through hole in the cup and being fixed at one end by positioning means in the central point of the spherical cap zone at the opposite end of said tie rod means.

7. A lattice structure as claimed in claim 6, wherein said tie rod means extends outwards beyond a threaded zone provided for the tightening of a nut, by a length such as to allow the fixing of accessory structures and apparatus.

* * * * *